US009039575B2

(12) United States Patent
Holland

(10) Patent No.: US 9,039,575 B2
(45) Date of Patent: May 26, 2015

(54) SPORTS TRAINING LADDER

(71) Applicant: Pro Performance Sports, L.L.C., Carlsbad, CA (US)

(72) Inventor: Allen Holland, Sheffield (GB)

(73) Assignee: Pro Performance Sports, L.L.C., Carlsbad, CA (US)

( * ) Notice: Subject to any disclaimer, the term of this patent is extended or adjusted under 35 U.S.C. 154(b) by 260 days.

(21) Appl. No.: 13/847,852

(22) Filed: Mar. 20, 2013

(65) Prior Publication Data

US 2014/0287878 A1 Sep. 25, 2014

(51) Int. Cl.

| | |
|---|---|
| ***A63B 22/00*** | (2006.01) |
| ***A63B 71/00*** | (2006.01) |
| ***A63B 5/02*** | (2006.01) |
| ***A63B 67/00*** | (2006.01) |
| ***A63B 69/00*** | (2006.01) |
| ***A63K 3/04*** | (2006.01) |

(52) U.S. Cl.
CPC ..... *A63K 3/043* (2013.01)

(58) Field of Classification Search
USPC ..... 482/14–17, 23, 34, 35, 38–41, 51, 52, 482/74, 79, 81, 131, 148; 473/414, 415, 473/438, 440; 273/440, 441, 444; 182/21, 182/104, 152, 159, 194, 195; D21/662, D21/672, 685, 686, 691, 698, 706, 788
See application file for complete search history.

(56) References Cited

U.S. PATENT DOCUMENTS

| | | | | |
|---|---|---|---|---|
| 4,059,268 | A * | 11/1977 | Forrest | 473/440 |
| 6,475,116 | B2 * | 11/2002 | Chen Wu | 482/15 |
| 8,317,661 | B2 * | 11/2012 | Wight | 482/38 |
| 8,328,696 | B2 * | 12/2012 | Dieter | 482/51 |
| 2006/0229171 | A1 | 10/2006 | Severino | |
| 2006/0247100 | A1 | 11/2006 | Harker | |
| 2009/0156365 | A1 | 6/2009 | Prstojevich | |
| 2010/0298074 | A1 * | 11/2010 | Esposito | 473/438 |

FOREIGN PATENT DOCUMENTS

| | | | |
|---|---|---|---|
| JP | 2000-102625 | A | 4/2000 |
| JP | 2006-517818 | A | 8/2006 |

OTHER PUBLICATIONS

International Searching Authority, Korean Intellectual Property Office, The International Search Report and The Written Opinion issued in PCT Application No. PCT/US2014/031086 (Sep. 2, 2014).
Web page for Quick Ladder (Nov. 2011).

* cited by examiner

*Primary Examiner* — Oren Ginsberg
(74) *Attorney, Agent, or Firm* — Kenneth H. Ohriner; Perkins Coie LLP

(57) ABSTRACT

A sports training agility ladder is usable in a flat ladder position with the ladder rungs on or close to the ground. The ladder may also be moved into and used in a hurdle position where a bridge or center section of each rung is raised up off of the ground. The ladder accordingly provides advantages of an agility ladder and of hurdles. Each rung may have permanently attached left and right tubes forming a frame. Left and right elastic cords may extend through the left and right tubes. The ladder is consequently easily and compactly folded up for storage and transport, and quickly and easily unfolded for use in either the ladder position or the hurdle position.

19 Claims, 5 Drawing Sheets

SPORTS TRAINING LADDER

BACKGROUND OF THE INVENTION

An agility ladder is athletic training equipment used to improve an athlete's speed, balance or agility. A typical agility ladder has equally spaced apart rungs attached to left and right side rails. In use, the agility ladder is rolled out, unfolded or laid out onto the ground, with open foot spaces formed between the rungs and side rails. The athlete runs, hops or jumps through the agility ladder with the athlete's feet landing in the foot spaces. For example, in one exercise the athlete may try to quickly run between the rungs without touching them. Different training exercises may use different patterns of steps, jumps, or hops. These types of exercises help the athlete to learn balance, increase foot speed, and/or improve reaction timing.

Hurdles are individual raised barriers also used in athletic training. Generally, hurdles are spaced several strides apart, with the athlete running and jumping over each hurdle. Agility ladders and hurdles each provide different training attributes. Obtaining the benefits of both an agility ladder and hurdles requires both sets of equipment to be carried to the training location and then set up. The equipment may be bulky, heavy and difficult to carry and/or store. Hurdles also generally require staking into the ground, or use of weights, such as sandbags, to hold them upright. Accordingly, improved training equipment is needed.

SUMMARY OF THE INVENTION

A sports training agility ladder is usable in a flat ladder position with the ladder rungs on or close to the ground. The ladder may also be moved into and used in a hurdle position where a bridge or center section of each rung is raised up off of the ground. The ladder accordingly provides advantages of an agility ladder and of hurdles. Each rung may have permanently attached left and right tubes forming a frame. Left and right elastic cords may extend through the left and right tubes. The ladder is consequently easily and compactly folded up for storage and transport, and quickly and easily unfolded for use in either the ladder position or the hurdle position.

BRIEF DESCRIPTION OF THE DRAWINGS

In the drawings, the same element number indicates the same element in each of the views.

DETAILED DESCRIPTION OF THE DRAWINGS

Figure 1:
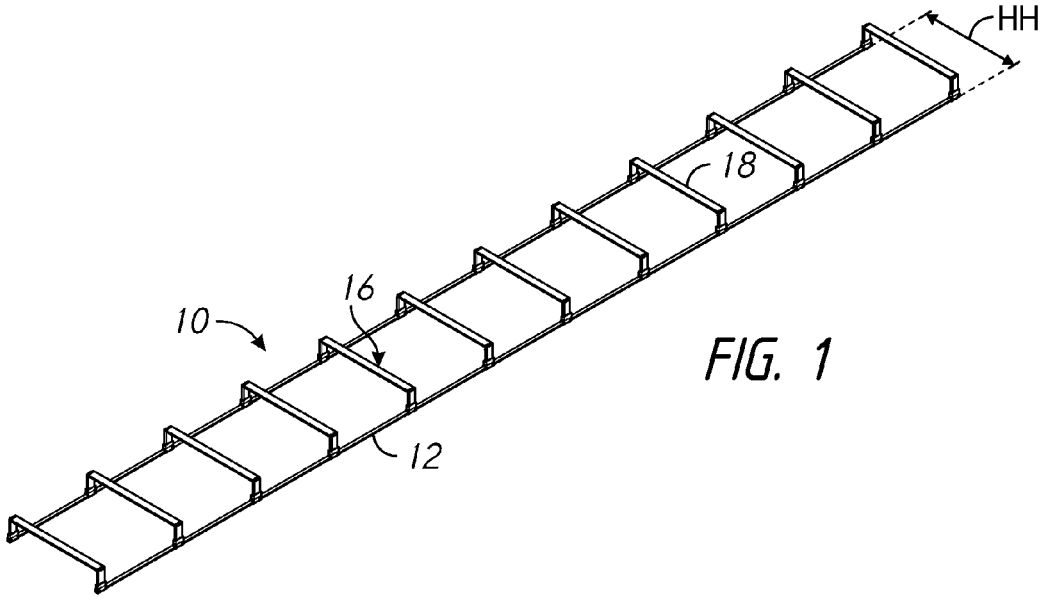
FIG. 1 is a perspective view of the present sports training ladder set up in the hurdle position.
Figure 2:
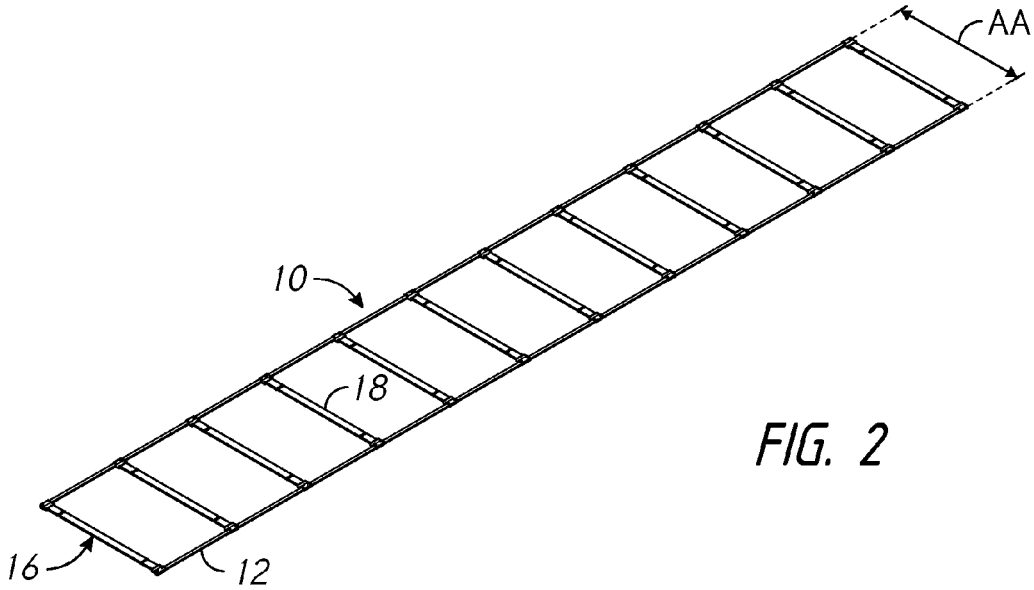
FIG. 2 is a perspective view of the sports training ladder of FIG. 1 now in the ladder position.

Turning now in detail to the drawings, as shown in FIGS. 1 and 2, a sports training ladder 10 includes tubes 12 extending between rungs 16. With a ladder having a length of 4.6 meters (15 feet), the rungs 12 are spaced apart on about 0.4 meter (16 inch) centers. The spacing between the rungs may vary for example with a ladder for youth training having closer spaced rungs in comparison to a ladder for adult training. Generally the rungs are equally spaced apart, meaning that the tubes 12 all have the same length. However, the rungs may optionally have different spacing, such as progressively closer spacing, or random spacing.

The ladder shown in FIGS. 1 and 2 has 12 rungs 16. Variations of this design having from 3 to 11 rungs, or having more than 12 rungs may also be used.

Figure 3:
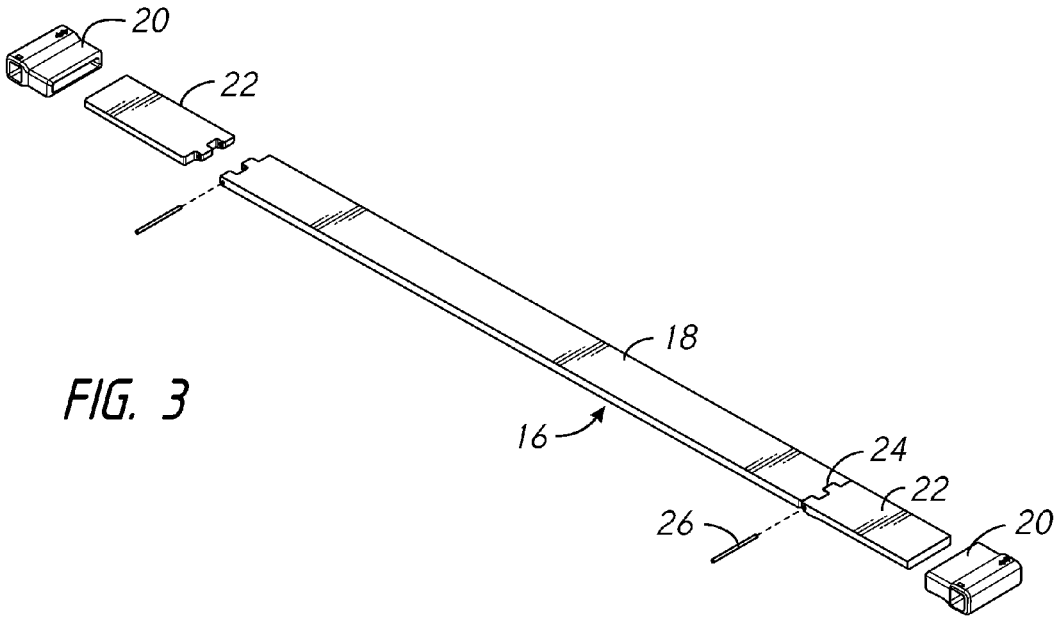
FIG. 3 is an exploded top perspective view of a rung of the ladder shown in FIGS. 1 and 2.
Figure 4:
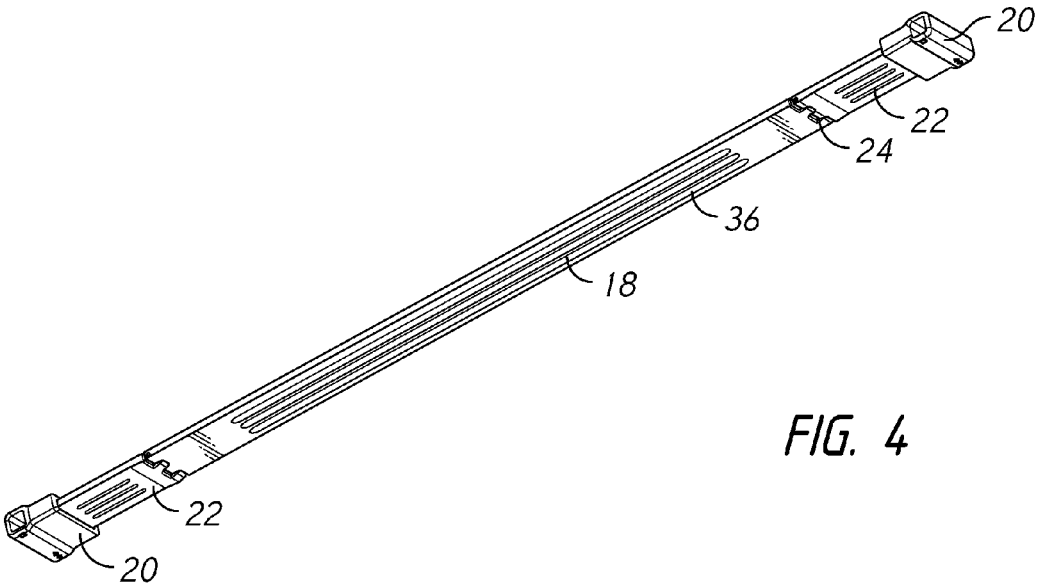
FIG. 4 is a bottom perspective view of the rung shown in FIG. 3.

As shown in FIGS. 3 and 4, each rung may include left and right risers 22 each pivotally attached to a bridge 18 via a hinge 24. The outer end of each riser is attached to a fitting 20. The bridge and/or the risers 22 may be flat rectangular solid or hollow tubular sections of various materials. Plastic materials, such as polypropylene may be used to provide lightweight risers and bridges with sufficient strength and stiffness. Generally the bridge 18 and risers 22 have a rectangular cross section, although square, round and other shapes may also be used, including shapes having rounded edges, such as a rectangle with curved shorter sides, instead of flat sides and sharp corners. The bridge 18 and risers 22 generally are straight, but they may optionally be curved, or have curved sections.

In an alternate design, the risers and hinges may be omitted with a highly flexible bridge extending across from the left side tubes to the right side tubes, to allow the ladder 10 to be placed into the hurdle and ladder positions shown in FIGS. 1 and 2. In this case, with the ladder in the hurdle position the bridges may be in the form of an arc. As shown in FIG. 4, grooves 36 may be provided on the bottom surface of the bridge 18 and/or the risers 22 to reduce weight. Slots extending entirely through the bridge and/or risers may alternatively be used in place of the grooves 36.

The bridge typically has a length (between the hinges 24) of about 0.3 to 0.7 meters, with a length of about 0.5 meters (20 inches) suitable for most designs. The length of the risers 22 varies depending on the desired height of the bridge 18 when the ladder 10 is used in the hurdle position shown in FIG. 1. The riser length also depends on the dimensions of the fitting 20. Generally the length of the risers 22 may be selected along with the design of the fitting 20 so that the top surface of the bridge 18 is from about 5 or 10 cm to about 30 or 40 cm above the ground. The width AA of the ladder 10 as shown in FIG. 2 typically ranges from about 0.5 to 1 meter, with dimensions of 0.6 to 0.75 meters more characteristically used. As shown in FIG. 1, the ladder 10 has a width HH when in the hurdle position. The ratio of HH to AA may range from 0.5 to 0.9 or 0.6 to 0.8.

Figure 5:
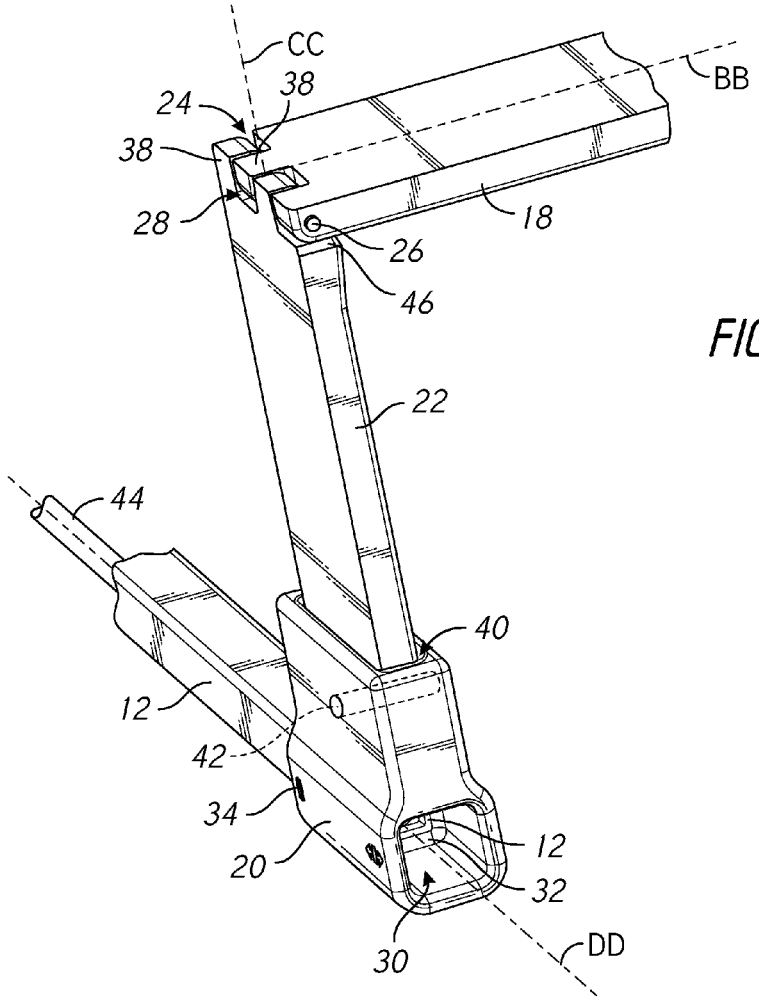
FIG. 5 is an enlarged partial perspective view the shown in FIGS. 3 and 4 with the ladder in the hurdle position.
Figure 6:
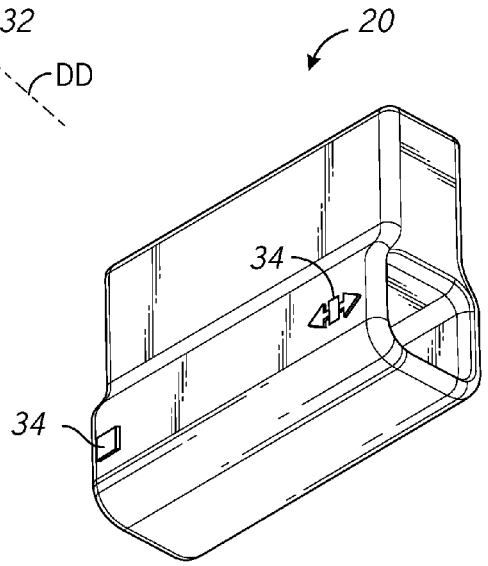
FIG. 6 is an enlarged perspective view of the rung fitting shown in FIG. 5.

The hinge 24 may be provided in various forms. As shown in FIG. 5, the outer ends of the bridge 18 and the risers 22 may have hinge tabs 38 spaced apart by hinge slots 28, with a pin 26 extending through them. Separate conventional hinges may also be attached to the bridge and risers via fasteners to provide pivotal attachments. Alternatively, so-called living hinges formed via a thin section of flexible material, such as plastic may be used. A stop surface 46 may be provided at the top end of the riser 22 (or on the outer end of the bridge 18) to prevent the bridge 18 from pivoting past the right angle position shown in FIG. 5 and into a dihedral orientation.

Referring still to FIG. 5, each riser 22 may be permanently attached to a fitting 20 with the lower end of the riser 22 inserted into a riser slot 40 in the fitting 20, and with a fastener or pin 42 extending through both the fitting and the lower end of the riser. Adhesives or other attachment techniques may also be used. Optionally, the risers 22 may simply be temporarily inserted into the riser slots 40 in the fittings 20, when the ladder 10 is set up for use, and then pulled out for storing the ladder in a compact space. A tube slot or socket 30 extends through the fitting 20 perpendicular to the riser slot 40. A divider 32, such as a projection or tab may be provided at a central position in the tube socket 30, to automatically help center the ends of the tubes in the fittings 20. Referring still to FIG. 5, with the ladder 10 assembled and placed into the hurdle position, the axis BB of the bridge is substantially perpendicular to the axis CC of both risers 22, and the axis DD of the tubes 12 is substantially perpendicular to axis BB and axis CC.

Various types of tubes may be used. As shown in FIG. 5, each tube 12 is generally square with rounded corners. Other tube shapes may also be used, specifically round tubes. If round tubes are used and are not permanently attached to a fitting, a key in the tube socket 30 may engage a slot in the end of the tube, or vice versa, to prevent the tubes from rotating in the tube sockets 30. The tubes 12 are advantageously hollow to reduce weight. Tubes in the shape of a polygon having sides ranging from 0.5 to 5 cm may be used. For example the generally square tube 12 shown in FIG. 5 may be 0.8 to 1.2 cm wide. The tube length will vary depending upon the desired foot space dimension of the ladder, with tube lengths of 30 to 50 cm typical. An elastic cord 44 may extend through the tubes 12 and the fittings 20 to hold them in sequence when the ladder is un-assembled, similar to the use of elastic cord in tent poles. The tubes 12, fittings and risers on the left and right sides, and the bridges may optionally be identical on each of the rungs. As used here, identical means capable of being used interchangeably. The tubes may be made of various materials, including plastics, such as polypropylene.

In use, the ladder 10 may be provided in an unassembled condition with the rungs folded over on each other. This allows the ladder 10 to be stored and carried in a compact space and easily set up. To set up the ladder 10, the rungs 16 are unfolded and laid out onto the ground. The ends of the tubes are inserted into the tube sockets 30 in the fittings 20. A detent or latch 34 may optionally be provided on the fittings 20 to more positively attach the tube ends into the fittings. If no latch 34 is used, the tube ends are held into the fittings via friction. For use as a flat agility ladder, the ladder 20 is set up as shown in FIG. 2, with the bridge and risers of each rung 16 on or close to the ground. To convert the ladder into the hurdle position shown in FIG. 1, one side of the ladder is moved towards the other. As this occurs, the risers 22 pivot from the horizontal position where they are generally parallel to the brides 18, to a generally vertical position shown in FIG. 5, where the risers are generally perpendicular to the bridges 18.

The ladder may also be designed with tubes 12 permanently attached to only one side the fittings 20 of each rung 16 to form a series of optionally identical U-shaped frames. In this case, the ladder 10 may be stored with the U-shaped frames conveniently folded over on top of each other. As used here, permanently attached means not removable by hand in the ordinary course. Releasably attached means removably by hand. Attached means permanently attached or releasably attached.

Figure 7:
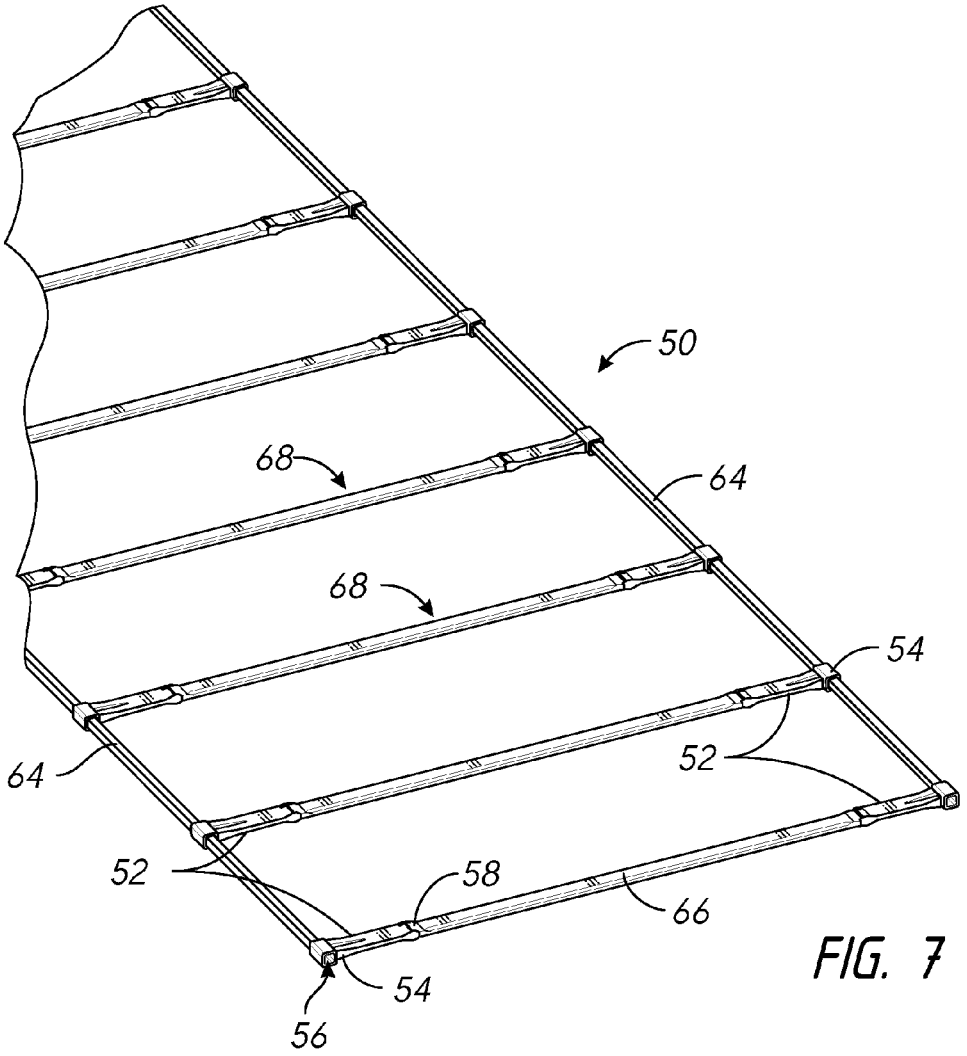
FIG. 7 is a perspective view of another embodiment in a ladder position.
Figure 8:
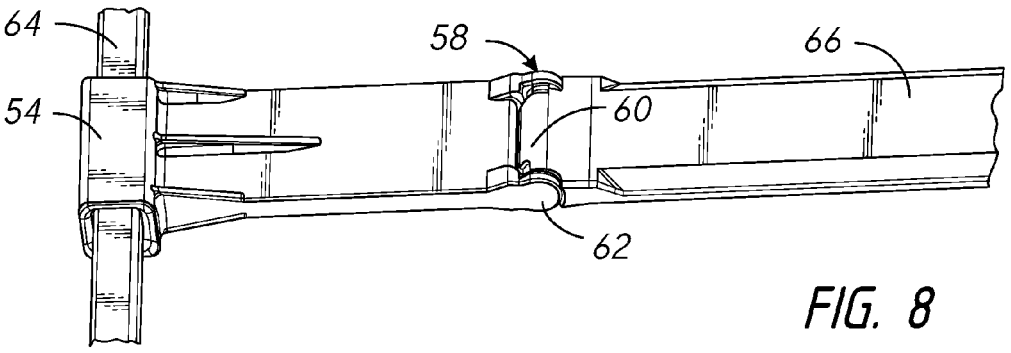
FIG. 8 is an enlarged perspective view of the hinge shown in FIG. 7.
Figure 9:
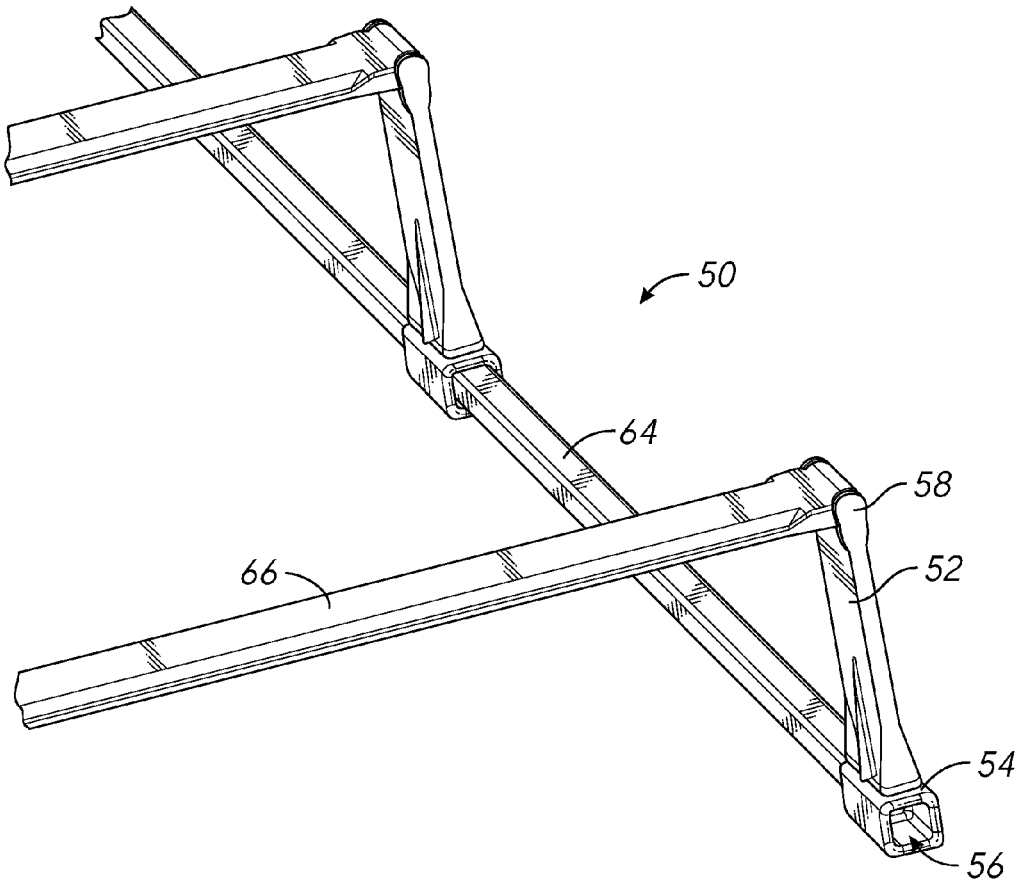
FIG. 9 is an enlarged perspective view of the front end of the training ladder shown in FIG. 7 now in the hurdle position.

FIGS. 7-9 show an alternative design 50 where the riser 52 includes an integral end fitting 54, rather than a separate end fitting component as shown in FIGS. 1-6. The end fitting 54 has a polygonal through hole 56. A hinge 58 pivotally attaches the upper or inner end of each riser 52 to a bridge 66. In the example shown, the hinge is formed via a hinge tube 62 pivotally retained within hook 60 on the bridge 66. If the hook 60 is sufficiently resilient, the hinge tube 62 may be snapped or pressed into the hook. Polygonal side tubes 64 extend through the hole 56 in each riser 52, on the left and right sides of the ladder 50. The side tubes 64 may be rigid triangular, square, rectangular, or other polygonal shapes. The side tubes 64 may extend continuously through all of the rungs 68 of the ladder 50, with the rungs sliding on the side tubes 64 to appropriate positions during set up. Detent fittings may optionally be provided on the side tubes 64 to help position the rungs 68 uniformly spaced apart, and to hold the rungs 68 in place during use. Alternatively, the side tubes 64 may be provided as individual segments with a pair of side tube segments between adjacent rungs 68.

Thus, a novel agility ladder has been shown and described. Various changes and modifications may be made without departing from the spirit and scope of the invention. The invention, therefore, should not be limited, except by the following claims and their equivalents.

The invention claimed is:

1. A sports training ladder, comprising:

a plurality of rungs with each rung it eluding a bridge having a left end pivotally attached to an upper end of a left riser, and a right end pivotally attached to an upper end of a right riser;

a left fitting at a lower end of the left riser and a right fitting at a lower end of the right riser;

a left pole attached to the left fitting and a right pole attached to the right fitting, with the left pole substantially perpendicular to the left riser and the bridge, and with the right pole substantially perpendicular to the right pole and the bridge; and with the ladder movable from a ladder position wherein the risers are substantially parallel to the bridge, to a hurdle position wherein the risers are substantially perpendicular to the bridge.

2. The ladder of claim 1 wherein the ladder has a width AA when in the ladder position and a width HH when in the hurdle position, and wherein the ratio of HH to AA ranges from 0.5 to 0.9.

3. The ladder of claim 2 wherein ratio of HH to AA ranges from 0.6 to 0.8.

4. The ladder of claim 1 with substantially each bridge having at least one bridge hinge tab and each riser having at least one riser hinge tab, and with a hinge pin extending through the bridge and riser hinge tabs to pivotally attach the bridge to the riser.

5. The ladder of claim 1 wherein the left riser, the riser, and the bridge have the same cross section shape and dimensions.

6. The ladder of claim 5 with the left riser, the right riser and the bridge comprising hollow tubes.

7. The ladder of claim 6 with the left riser, the right riser and the bridge having rectangular tubular cross-sections.

8. The ladder of claim 1 further comprising a stop surface at the upper end of the left and right riser.

9. The ladder of claim 1 with substantially each rung comprising a frame including the bridge, the left and right risers permanently attached to the bridge, the left and right fittings permanently attached to the left and right risers, a left tube permanently attached to the left fitting and a right tube permanently attached to the right fitting.

10. The ladder of claim 1 further including a left elastic cord extending through the left tube and the left fitting and a right elastic cord extending through the right tube and the right fitting.

11. The ladder of claim 1 wherein the bridge is straight and flat.

12. The ladder of claim 1 wherein the risers are straight and flat.

13. The ladder of claim 1 wherein the left riser is identical to the right riser.

14. The ladder of claim 1 wherein the left fitting is identical to the right fitting.

15. The ladder of claim 1 with the left and right fitting each having a flat bottom surface.

16. A sports training ladder, comprising:

a first rung including a first bridge having a left end pivotally attached to a first left riser, and a right end pivotally attached to a first right riser; a first left fitting on the first left riser and a first right fitting on the first right riser; and a first left pole permanently attached to the first left fitting and a first right pole permanently attached to the first right fitting, with the first left pole substantially parallel to the first right pole and with both poles substantially perpendicular to the first bridge;

a second rung including a second bridge having a left end pivotally attached to a second left riser, and a right end pivotally attached to a second right riser; a second left fitting on the second left riser and a second right fitting on the second right riser; a second left pole releasably attached to the first left fitting and permanently attached to the second left fitting, and a second right pole releasably attached to the first right fitting and permanently attached to the second right fitting, with the second left pole substantially parallel to the second right pole and with second left and right poles substantially perpendicular to the second bridge.

17. The ladder of claim 16 further comprising a third rung including a third bridge having a left end pivotally attached to a third left riser, and a right end pivotally attached to a third right riser; a third left fitting on the third left riser and a third right fitting on the third right riser; and a third left pole releasably attached to the second left fitting and permanently attached to the third left fitting, and a third right pole releasably attached to the second right fitting and permanently attached to the third right fitting, with the third left pole substantially parallel to the third right pole and with the third left and right poles substantially perpendicular to the third bridge.

18. The ladder of claim 17 further comprising a left elastic cord extending through the first, second and third left poles and the left fittings, and a right elastic cord extending through the first, second and third right, poles and the right fittings.

19. The ladder of claim 17 with the ladder movable from a ladder position wherein the riser and the bridges are substantially flat on the ground, to a hurdle position wherein the bridges are from 3 to 30 cm up off of the ground.

* * * * *